US006113456A

United States Patent [19]

Hadzicki et al.

[11] Patent Number: 6,113,456

[45] Date of Patent: Sep. 5, 2000

[54] ULTRA PERFORMANCE MODULAR YO-YO WITH STRING FINGER GUARD

[76] Inventors: Joseph R. Hadzicki, 415 "I" St., Coronado, Calif. 92118; David H. Hadzicki, 11715 Treadwell Dr., Poway, Calif. 92064

[21] Appl. No.: 09/161,345

[22] Filed: Sep. 25, 1998

[51] Int. Cl.[7] ..... A63H 1/30

[52] U.S. Cl. ..... 446/250

[58] Field of Search ..... 446/247, 248, 446/250, 253

[56] References Cited

U.S. PATENT DOCUMENTS

| | | | |
|---|---|---|---|
| 668,829 | 2/1901 | Boehme | 446/250 |
| 3,081,578 | 3/1963 | Mosher | 446/250 |
| 3,175,326 | 3/1965 | Isaacson | 446/250 |
| 3,805,443 | 4/1974 | Duncan, Jr. | 446/250 |
| 4,130,962 | 12/1978 | Ennis . | |
| 4,332,102 | 6/1982 | Caffrey . | |
| 4,895,547 | 1/1990 | Amaral . | |
| 5,100,361 | 3/1992 | Kuhn et al. . | |
| 5,184,972 | 2/1993 | Tomberlin . | |
| 5,389,029 | 2/1995 | McAvoy, Jr. . | |
| 5,769,686 | 6/1998 | Duncan et al. . | |

OTHER PUBLICATIONS

W. Bürger, "The Yo–yo: A Toy Flywheel," *American Scientist*, 72:137–142 (Mar./Apr., 1984).

*Primary Examiner*—Robert A. Hafer
*Assistant Examiner*—Jeffrey D. Carlson
*Attorney, Agent, or Firm*—Baker & Maxham

[57] ABSTRACT

An ultra performance yo-yo having greatly improved spinning characteristics formed of two sections made of it least two materials, so that a substantial portion of the weight of each section is located about a periphery of the section thereby maximizing the rotational inertia of the yo-yo, and an axle assembly positioned between the two sections locating them in a spaced apart relationship. A string finger guard is used with the yo-yo string, and comprises a flexible sleeve having a longitudinal aperture, with a flexible leash slidably positioned in the longitudinal aperture. The yo-yo string is coupled to the leash, and the flexible sleeve protects the player's finger from pinching and discomfort.

26 Claims, 7 Drawing Sheets

ULTRA PERFORMANCE MODULAR YO-YO WITH STRING FINGER GUARD

BACKGROUND OF THE INVENTION

1. Field of the Invention

The present invention generally relates to yo-yos, and pertains particularly to a yo-yo having an optimized rotational inertia with a string finger guard.

2. Discussion of the Related Art

Yo-Yos are popular toys which consist of two disk-like structures that are positioned axially adjacent to each other on an axle and having a string that is connected to the finger of a player when in use. The player "throws" the yo-yo, transferring kinetic energy to the yo-yo, which unwinds the string causing the yo-yo to spin about its axle. Tricks must be performed quickly while the yo-yo is spinning so that the yo-yo has enough kinetic energy at the end of the trick to return up the string into the hand of the player. Thus, a yo-yo that has a long spin time allows the player to perform difficult tricks and increases enjoyment of the toy.

The kinetic energy, K, of a spinning, or rotating rigid body like a yo-yo is expressed by the equation: $K=\frac{1}{2}I\omega^2$, where "ω" is the angular speed about an axis (the axle), and "I" is the rotational inertia of the rigid body. I is a measure of the resistance a body offers to a change in its rotational motion about a given axis. So a yo-yo with a large I, or rotational inertia will resist any change in its rotational motion and spin for a longer period of time. Rotational inertia is unique to each physical shape. For a solid disk having uniform thickness and density, similar to many yo-yos, $I=\frac{1}{2}MR^2$, where R is the radius of a uniform disk of mass M. Where the mass M is positioned at a specific radius, as in a hoop, or ring, $I=MR^2$, which is twice the rotational inertia of a disk where the mass is distributed uniformly along the disk radius. Therefore, the rotational inertia, and thus the propensity for a yo-yo to remain spinning can be increased by locating the mass of the yo-yo as far away from the axle, or rotational axis as possible. In other words, maximizing the rotational inertia of a given yo-yo mass maximizes the efficiency and performance of the yo-yo, resulting in a superior toy.

Also, a yo-yo must fit comfortably in the hand of a player and therefore a yo-yo cannot be too large in diameter. Until now yo-yo design was driven by cost considerations, and cost-effective plastic injection-molded yo-yos have dominated the child and young adult market, but are limited in their spinning performance due to the limited material that can be distributed about the yo-yos periphery. However, yo-yos and the relaxation of yo-yo playing are appealing to adults who have the resources to purchase more expensive, and sophisticated Yo-yos with optimized spinning performance. Accordingly, there is a need for an improved yo-yo having high efficiency and performance characteristics.

However, a yo-yo with enhanced performance exerts higher stresses on the yo-yo string which is attached to the finger of the player. This woven cotton string is also known as a standard twisted pair strand tether. As shown in FIG. 6, the yo-yo string has a relatively small diameter and is usually attached to the middle finger of the throwing hand. The prior method of attachment to the finger is to tie a loop at the end of string and then pull a section of string through the loop forming a noose that is pulled over the finger (FIG. 6). As the player repeatedly throws the yo-yo the noose squeezes and pinches the finger. The pinching of the noose around the player's finger causes discomfort and restricts blood flow to the finger, thus limiting playing time and distracting from the enjoyment of playing with the toy.

Accordingly, there is a need for a device that connects the yo-yo to the player's finger and that does not cause discomfort and permits unlimited playing time.

SUMMARY OF THE INVENTION

It is the primary object of the present invention to provide an improved yo-yo having greatly increased spinning characteristics.

In accordance with a primary object of the present invention, a yo-yo is provided with inertial disks having their mass concentrated at an optimum position for maximizing rotational inertia. More specifically, a preferred embodiment of the invention uses extremely light-weight webs, or disks having heavier rings coupled to or mounted on the outer periphery of the webs, thereby maximizing the rotational inertia of the yo-yo resulting in greatly enhanced spinning performance.

Another aspect of the present invention includes a yo-yo with inertial disks that twist relative to the axle for changing the gap between the inertial disks to adjust the sleep characteristics of the yo-yo.

Another aspect of the present invention includes a yo-yo string finger guard that is comprised of a flexible sleeve having a longitudinal aperture, with a flexible leash slidably positioned in the longitudinal aperture. The yo-yo string is coupled to the leash, and the flexible sleeve protects the player's finger from pinching and discomfort.

BRIEF DESCRIPTION OF THE DRAWINGS

The nature, objects, and advantages of the invention will become more apparent to those skilled in the art after considering the following detailed description in connection with the accompanying drawings, illustrating by way of example the principles of the invention, in which like reference numerals designate like parts throughout, wherein.

DETAILED DESCRIPTION OF THE PREFERRED EMBODIMENTS

General

Figure 1:
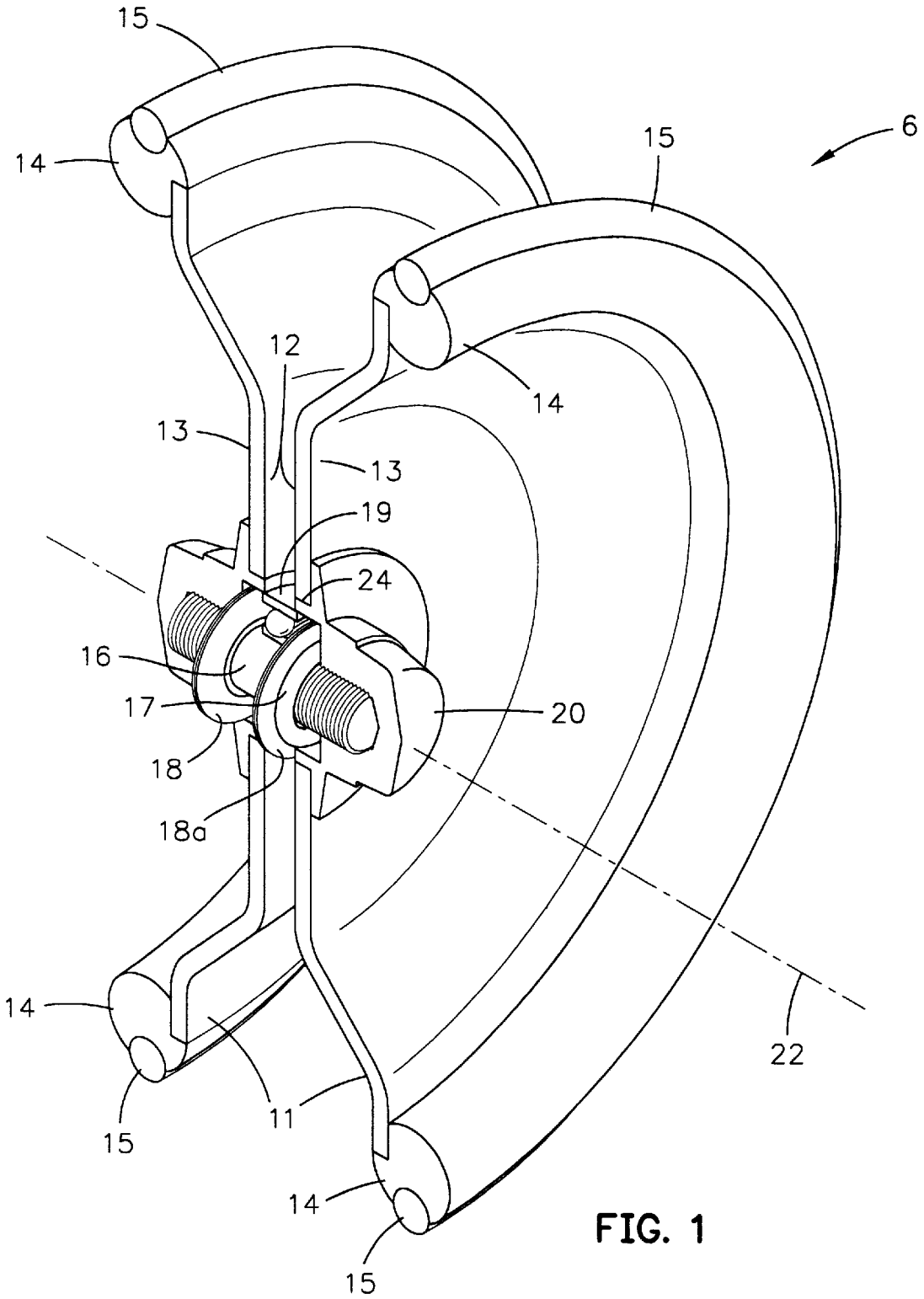
FIG. 1 is a perspective cross-sectional view of a preferred embodiment of the present invention.
Figure 7:
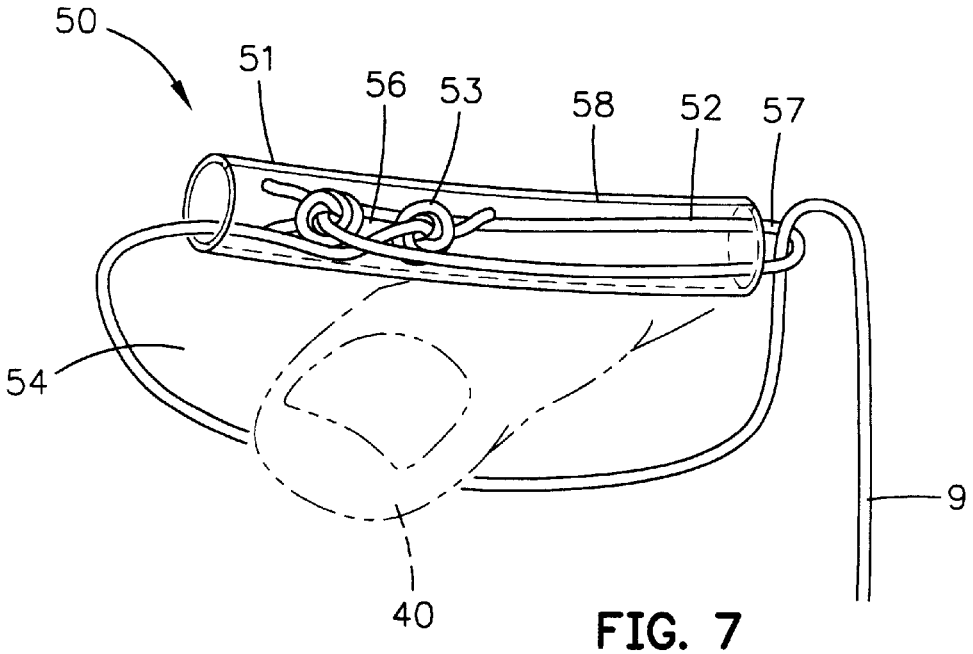
FIG. 7 is a perspective view of a yo-yo string engaged with one embodiment of the string finger guard.

As shown in the drawings for purposes of illustration, and throughout this description, the preferred embodiment and examples shown should be considered as exemplars, rather than as limitations on the present invention. Referring to FIG. 1, a yo-yo in accordance with one embodiment of the invention is illustrated and designated generally by the numeral 6. A preferred yo-yo embodiment has two webs with a concentrated mass distributed about each web periphery for optimizing the rotational inertia of the yo-yo. This yo-yo assembly is robust due to the high-strength, yet light-weight materials employed in its construction, which allows a concentrated mass to be positioned about the yo-yo periphery resulting in vastly improved spinning characteristics. Referring to FIG. 7, a string finger guard in accordance with one embodiment of the invention is illustrated and designated generally by the numeral 50. A preferred string finger guard embodiment has a flexible sleeve and a flexible ring which cushions the string, yet securely surrounds the finger of a player, allowing uninterrupted and extended playing time.

Structure

Referring to FIG. 1, the yo-yo 6 has two rotors, webs, or sections 11 each having an inner surface 12 and an outer surface 13. Each web is preferably circular, with a ring, or concentrated mass 14 located around the web periphery, or perimeter 26. The ring has a band, or hoop 15 positioned around the ring perimeter 21. The web is extremely light-weight, allowing most of the yo-yo weight to be located as far from the rotational axis 22 as possible.

Again referring to FIG. 1, at the center, or rotational axis of each web 11 is a web opening 10 through which end cap, or hub 20 is mounted. Hub flange 24 is bonded, glued, or epoxied to the web opening and serves to connect the web to the shaft, or axle 16. The axle is threadably engaged into the hub aperture 23 and positions each hub, and each web, in a spaced relationship that can be varied by rotating, or twisting one or both hubs relative to the axle. The hub can be made from aluminum, titanium, or steel. Positioned between each hub on the axle are two O-rings 17, two bearing washers 18, two O-ring washers 18*a,* and a roller bearing 19.

Figure 2:
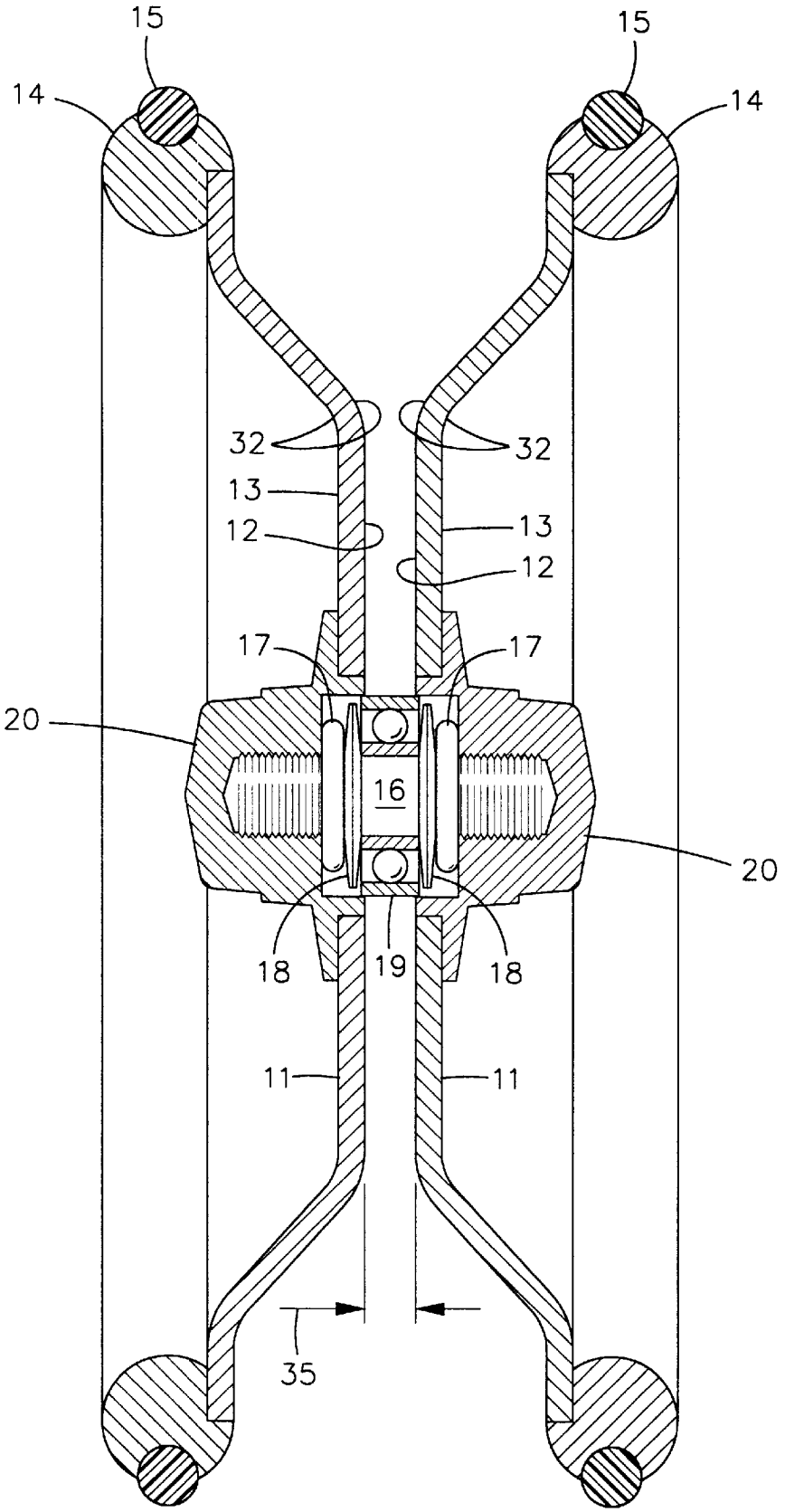
FIG. 2 is a cross-sectional view of the FIG. 1 embodiment.

Referring to FIG. 2, the roller bearing is centrally located on axle 16 and has an outer race 28, and an inner race 27, with the inner race contacting axle 16. The roller bearing is preferably a roller, or precision, or "frictionless" type, having either ball bearings, or roller bearings 29 shielded, or sealed between the inner and outer races. A string, or tether 9 is wrapped about the outer race, and the roller bearing permits the yo-yo 6 to spin while the outer race 28 is stationary relative to the string.

Two bearing washers 18 are positioned on ether side of the bearing with bearing washer inner diameter 7 contacting the bearing inner race 27. O-ring washers 18*a* have inner diameter 7*a* contacting the O-ring 17, and an outer diameter 8*a* contacting the bearing washer outer diameter 8. Both O-ring and bearing washers are preferably cone shaped, are made of spring steel and ideally are of the "Belleville" type. As shown in FIG. 2, each hub 20 has threaded aperture 23 which screws onto threaded axle 16. Each hub inner face 25 contacts each O-ring 17. The O-rings press against the O-ring washers 18*a* which contact the bearing washers 18 which engage the bearing inner race 27. The cone shape of the washer prevents any contact with the bearing outer race 28. Washer contact with the bearing inner race prevents inner race movement relative to axle 16, but the bearing outer race can spin freely relative to the axle. Frictional contact from the O-ring rubber material keeps the hubs from unscrewing from axle 16. The O-rings also permit the web gap 35 to vary, while still keeping bearing washers 18, and O-ring washers 18*a* in firm engagement with the bearing 19.

Figure 3:
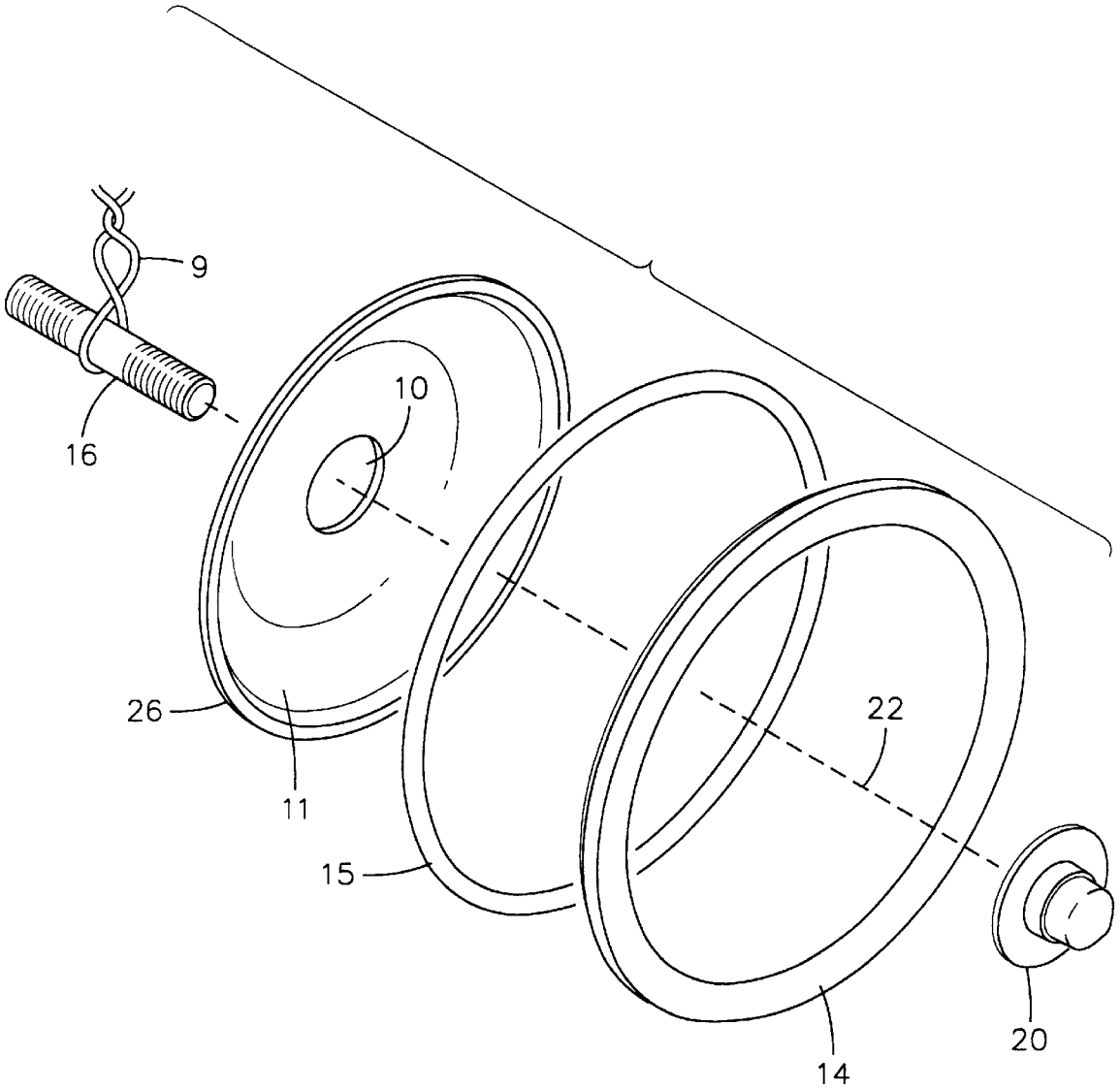
FIG. 3 is a perspective of view of the axle, web, ring, band, and hub of the FIG. 1 embodiment.
Figure 4:
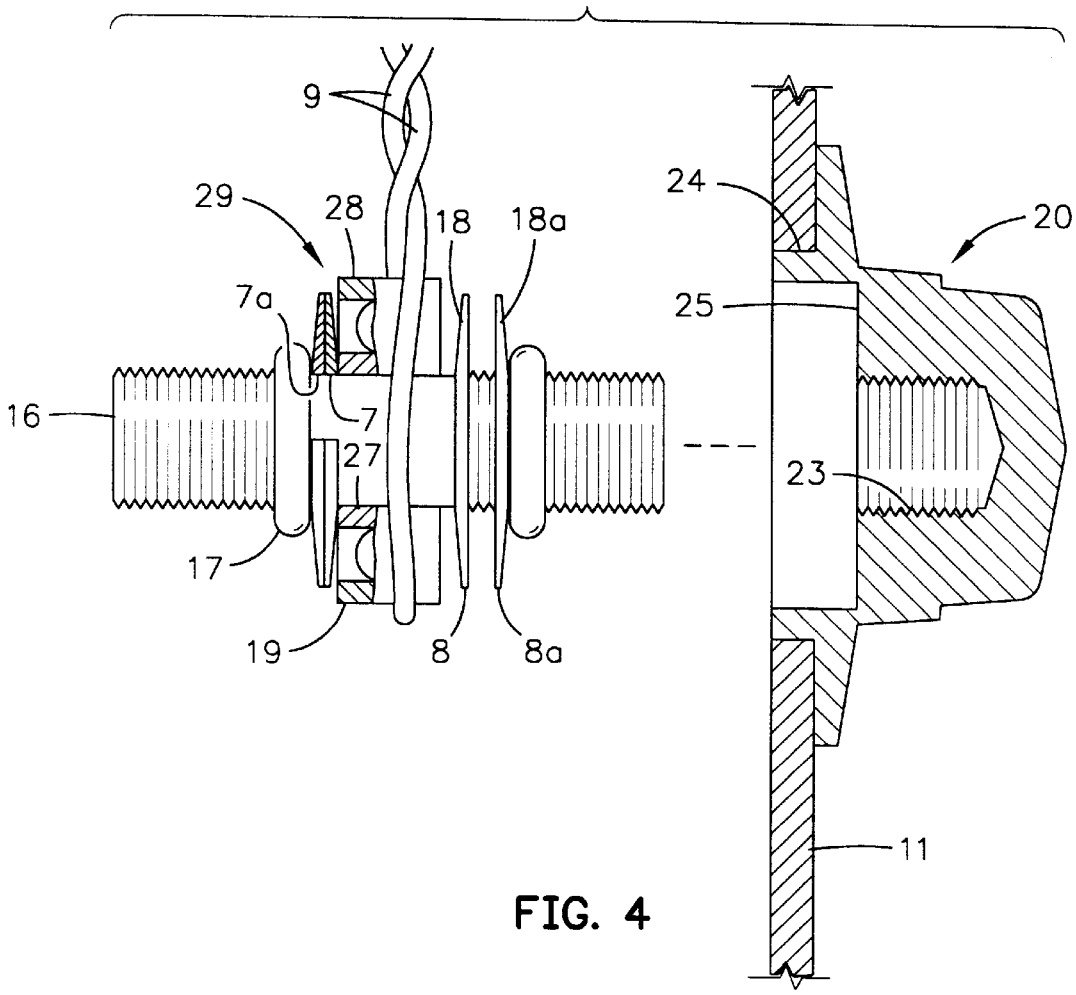
FIG. 4 is an elevation cross-sectional view of the axle and related components of the FIG. 1 embodiment.

Referring to FIGS. 3 and 4, the web, or rotor 11 is circular, or disk shaped and has a web opening 10, an inner surface 12, an outer surface 13, and a perimeter, or periphery 26. The web bend 32 curves the web so that about ⅓ to ½ of the web is tilted outward, in a dish or "butterfly" shape in cross section. The web has a very low mass, or weight and is preferably formed in a compression mold from a woven material made of graphite, or carbon fibers. Alternatively, KEVLAR, SPECTRA, or fiberglass materials are suitable for web construction (KEVLAR is a trademark of Du Pont de Nemours and SPECTRA is a trademark of Allied Signal). Preferably these fibers are pre-impregnated with resin and are thermosetting, i.e., upon exposure to elevated temperatures the material becomes rigid. However, pre-impregnated thermoplastic materials, i.e., materials that are still pliable at elevated temperatures are also acceptable. Webs manufactured from these materials are extremely light-weight yet also very strong. This allows most of the yo-yo weight to be concentrated about the circumference of the yo-yo, while keeping the total yo-yo weight within the desired range of 35 to 65 grams.

Figure 5:
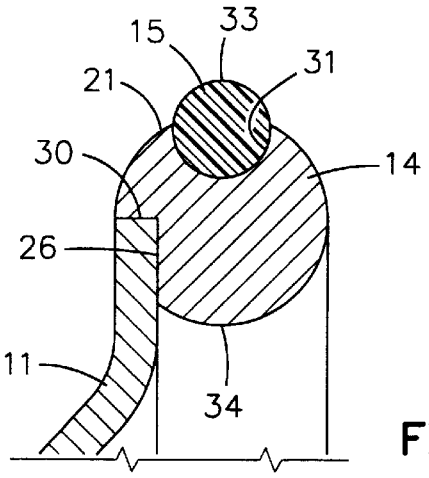
FIG. 5 is a cross-sectional view of a string, the web, ring, and band of the FIG. 1 embodiment.

Referring to FIGS. 3 and 5, the ring chamfer 30 mates to the web perimeter 26 and secures the ring 14 to the web 11. Preferably the rings are attached to the web by epoxy but glues or other bonding materials are acceptable. The rings can be made of steel, brass, aluminum alloys, copper, titanium, plastic, rubber, or doped rubber. Doped rubber is rubber with impurities such as steel or other dense materials mixed into it. When the rings 14 are constructed of any one of the above materials, and mounted around the web perimeter 26, they represent a substantial portion of the weight of the yo-yo. Also, as shown in FIGS. 1, 4 and 5, the essentially round cross-section of the rings serves to make the yo-yo 6 easier to grasp and protects the player from the sharp edge formed by web perimeter 26. Moreover, the shiny rings make the yo-yo 6 appearance unique and more attractive to consumers.

Again referring to FIGS. 3 and 5, band 15 is positioned in ring channel 31, which is located around ring perimeter 21. The band is preferably made of rubber, but can also be made of plastic and is either trapped in the channel by elastic force or is bonded, epoxied, or glued into the channel. Ideally, the band material is a variable density rubber that is soft on the outside surface and hard on the inside surface next to ring channel 31. The band 15 serves to increase the mass positioned about the yo-yo outer circumference, thus increasing rotational inertia. The rubber, or plastic surface of the band has better grip characteristics than a metal, or aluminum ring allowing a player to better grasp the yo-yo.

As an example, for the different yo-yo parts listed, the weight of each part in grams may exhibit parameters such as those of Table 1, below.

TABLE 1

| | Example Weight Ranges | Preferred Weights |
|---|---|---|
| Axle Assembly | 1 to 3 grams | 2.1 grams |
| Hub | 1 to 3 grams | 2.2 grams |
| Web | 5 to 10 grams | 7.7 grams |
| Ring | 8 to 13 grams | 11.6 grams |
| Band | 1 to 5 grams | 1.8 grams |

As shown in Table 1, the yo-yo axle assembly includes both O-rings 17, both bearing washers 18, both O-ring washers 18*a,* roller bearing 19, and axle shaft 16. The axle assembly can range between 1 to 3 grams, but is preferably 2.1 grams.

As an example, for the different yo-yo parts listed, the radius as measured from the center of axle 16 may exhibit parameters such as those of Table 2, below.

TABLE 2

| | Example Radius Ranges | Preferred Radius |
|---|---|---|
| Web | 25 to 33 millimeters | 31.5 millimeters |
| Ring | 27 to 35 millimeters | 33.0 millimeters |
| Band | 30 to 37 millimeters | 34.0 millimeters |

As shown in Table 2, the radius for web 11 is measured from the center of axle 16 to the web perimeter 26. The radius of the ring 14 is measured from the center of the axle to the center of the ring, and the ring is preferably 6 millimeters wide, therefore ring innermost surface 34 is located 30 millimeters from axle 16. The radius of band 15 is measured from the center of the axle to the center of the band, and the band is preferably 3 millimeters wide, therefore band outer surface 33 establishes a preferred maximum yo-yo radius of 35.5 millimeters, as shown in FIG. 5.

Using data from Tables 1 and 2, various characteristics of an exemplary embodiment yo-yo can now be determined. A total yo-yo weight of 48.7 grams can be found by summing the weight of the axle assembly with two hubs, two webs, two rings, and two bands. The weight of two rings and two bands equals 26.8 grams, which is 55% of the total weight of the yo-yo 6. The center of ring 14 is positioned 33 millimeters from the rotational axis of axle 16 and the ring is 6 millimeters wide, so ring innermost surface 34 is 30 millimeters from the rotational axis. The band outer surface 33 represents the yo-yo maximum radius of 35.5 millimeters. This results in a ring innermost surface positioned 85% of the distance from the rotational axis. Therefore this exemplary embodiment yo-yo has 55% of the total yo-yo weight positioned at least 85% of the distance from the rotational axis. This maximizes the rotational inertia of the yo-yo and thus greatly improves the yo-yo 6 spinning characteristics.

Operation

The string, or tether 9 represents a commonly available yo-yo string that is woven from cotton, and is specifically used for yo-yos. One end of the string is wrapped about the bearing outer race 28 and wound between the web inner surfaces 12, with the other end of the string attached to a finger 40 of the player.

Figure 6:
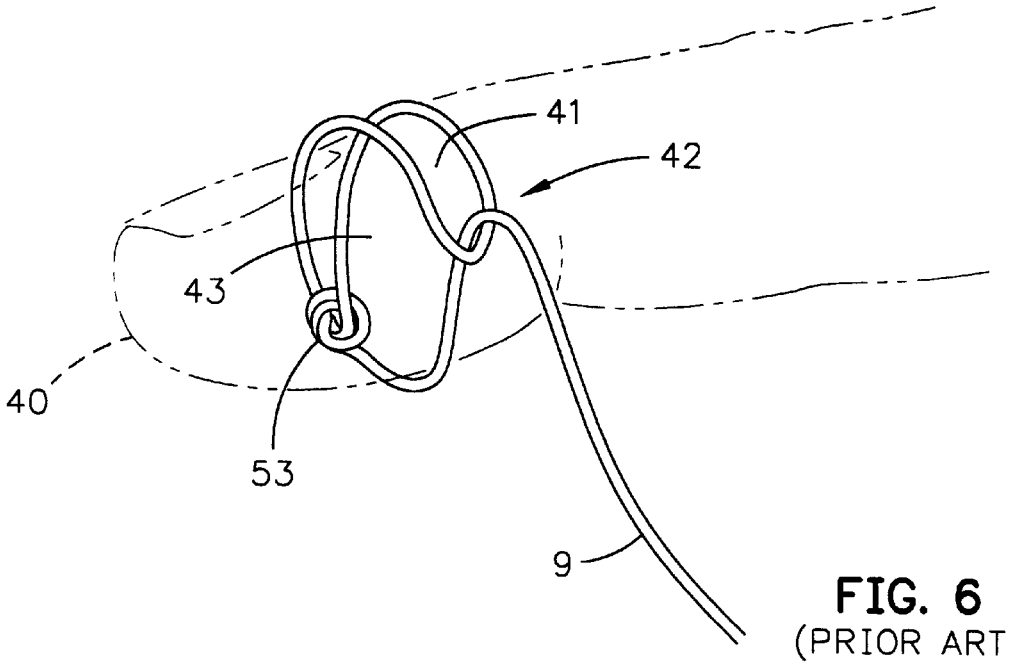
FIG. 6 (PRIOR ART)
FIG. 6 is a diagram showing the known method for attaching a yo-yo string to a finger.

Referring to FIG. 6, the prior method for attaching string 9 to the finger 40 is to first tie a loop 41 at the end of string 9 and then pull a section of string through the loop forming a running knot 42. An opening, or noose 43 is formed by the loop and the running knot, and the finger is inserted into the noose. As the player repeatedly throws the yo-yo the small diameter string 9 squeezes and pinches the finger causing discomfort and restricting blood flow to the finger, thus limiting playing time.

Figure 10:
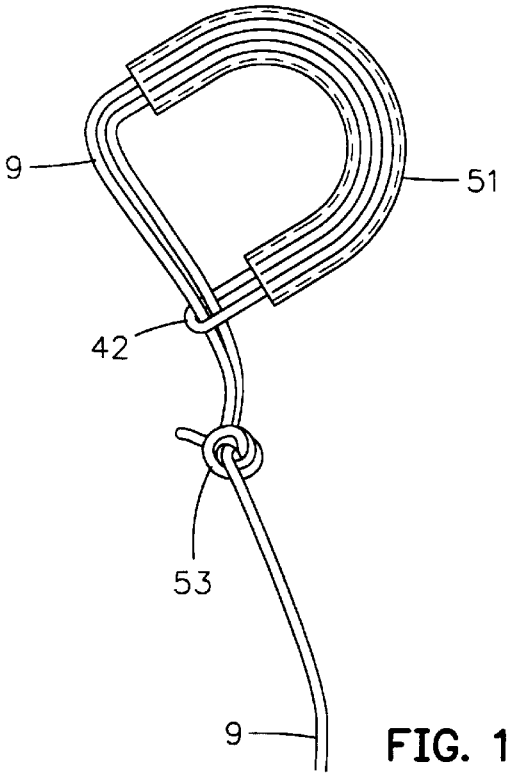
FIG. 10 is a perspective view of a yo-yo string and another embodiment of the string finger guard.

Referring to FIG. 7, a string sleeve system, or a string finger guard in accordance with one embodiment of the invention is illustrated and designated generally by the numeral 50. The finger guard protects a player's finger from the pinching and binding of the conventional string, and permits quicker and easier attachment of the finger guard 50, or the string 9 to the finger 40. The finger guard is comprised of a substantially cylindrical flexible cylinder, jacket or sleeve 51, and a flexible hitch, or leash 52. One embodiment of the leash 52 is comprised of a line of SPECTRA and is configured to have two generally U-shaped ends 56 and 57. An alternative embodiment would be comprised of a doubled-back section of string 9 formed in the end of the yo-yo string and inserted into the flexible sleeve 51, as shown in FIG. 10. The leash 52 could be either a continuous strand or line with no knots, or be comprised of a length of material doubled-back on itself and tied with a knot 53. The leash 52 can be made from materials such as plastic, rubber, polyester, cotton, hemp, nylon, KEVLAR, or SPECTRA (KEVLAR is a trademark of Du Pont de Nemours, and SPECTRA is a trademark of Allied Signal).

Again referring to FIG. 7, one embodiment of the pliable sleeve 51 has a length sufficient to encompass most of the finger 40, and both ends 56 and 57 of the leash 52 so that the string 9 will not pinch the finger 40. But, the length of sleeve 51 can also be shorter so that ends 56 and 57 protrude from sleeve 51, facilitating string 9 replacement. An alternative embodiment of the sleeve would have a slit, or opening 58 running lengthwise along either the entire length of the sleeve 51, or along only a portion of the length of the sleeve, which would now resemble a wrapper, or jacket. The string 9 could be inserted directly into the sleeve, or jacket through the slit. Also, the leash 52 could be inserted into the sleeve through the slit, greatly simplifying the string 9 replacement process. The sleeve 51 can be made from any generally pliable, or flexible material, including natural and man-made fabrics, animal skins or hides, plastic, silicone or rubber.

As shown in FIG. 7, the string 9 is passed through end 57 of the leash 52 and a knot or kink 53 is formed at one end of the string 9. The knot 53 is then placed through end 56 of the leash which is then pulled into the flexible sleeve 51, trapping, or capturing the knot 53 and thus the yo-yo string 9, therein. Alternatively, this process can be performed in reverse, with the knot 53 placed in the end 56 of the leash 52, then string 9 is inserted through end 57 of the leash. Ideally, the sleeve 51 serves to trap the knot 53 in the leash 52. However, the leash or sleeve can be configured so that both ends 56 and 57 protrude from the sleeve.

After the string 9 is routed through the leash 52, an opening, or noose 54 is formed. The player's finger 40 is then inserted into the noose 54 and the string 9 is pulled to secure the flexible sleeve around the finger. Because the diameter of the sleeve is larger than the diameter of the string 9, it does not pinch, or strangle the finger. Also, the pliable and cushioned surface of the sleeve is more comfortable than the twined cotton string. These features result in longer play time and blood flow to the finger is no longer restricted.

Figure 8A:
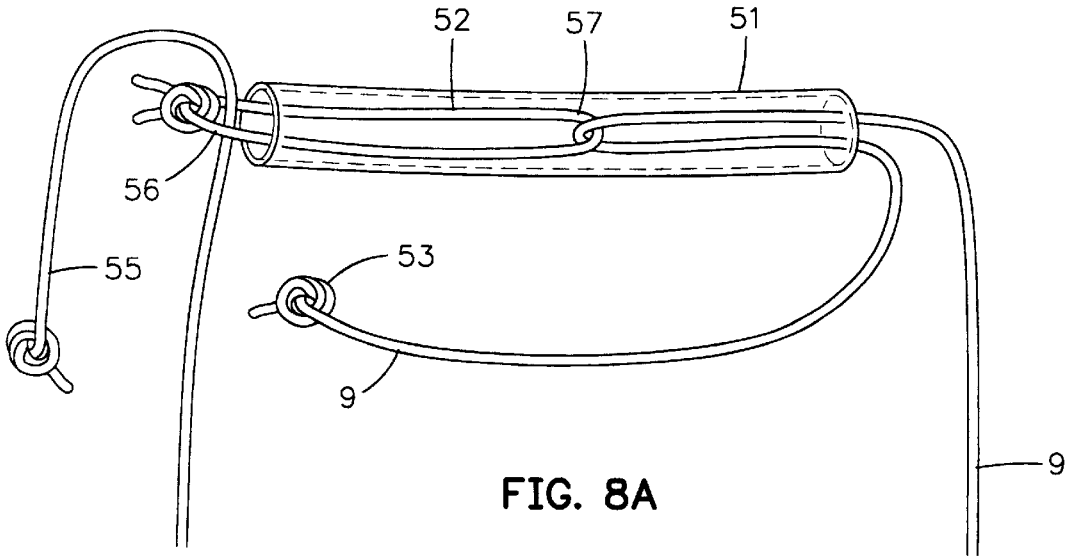
FIG. 8*a* shows a first step of a preferred two step method to replace an old yo-yo string with a new yo-yo string.
Figure 8B:
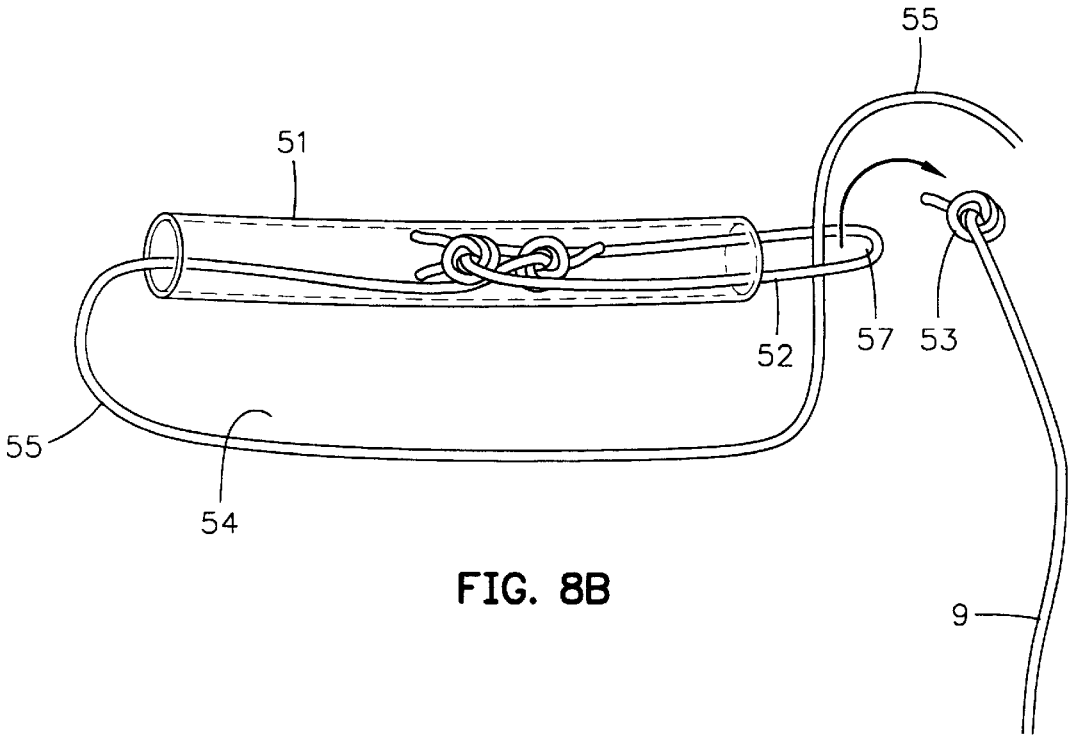
FIG. 8*b* shows a second step of a preferred two step method to replace an old yo-yo string with a new yo-yo string.

FIGS. 8*a* and 8*b* show the method by which string 9 is replaced with new string 55. In FIG. 8*a,* the flexible sleeve 51 is compressed, or shifted until the knotted end 53 of string 9 is exposed. The knotted end of the string 9 is then removed from the leash 52 and replaced with new string 55 which has been knotted in a similar manner. In FIG. 8*b,* the flexible sleeve 52 has been compressed, or shifted in the opposite direction allowing string 9 to be completely removed from the leash 52. New string 55 is then inserted into the leash 52, forming the opening, or noose 54 through which the player's finger 40 is inserted. This is only one example of a string 9 replacement method and alternative methods are possible.

Figure 9:
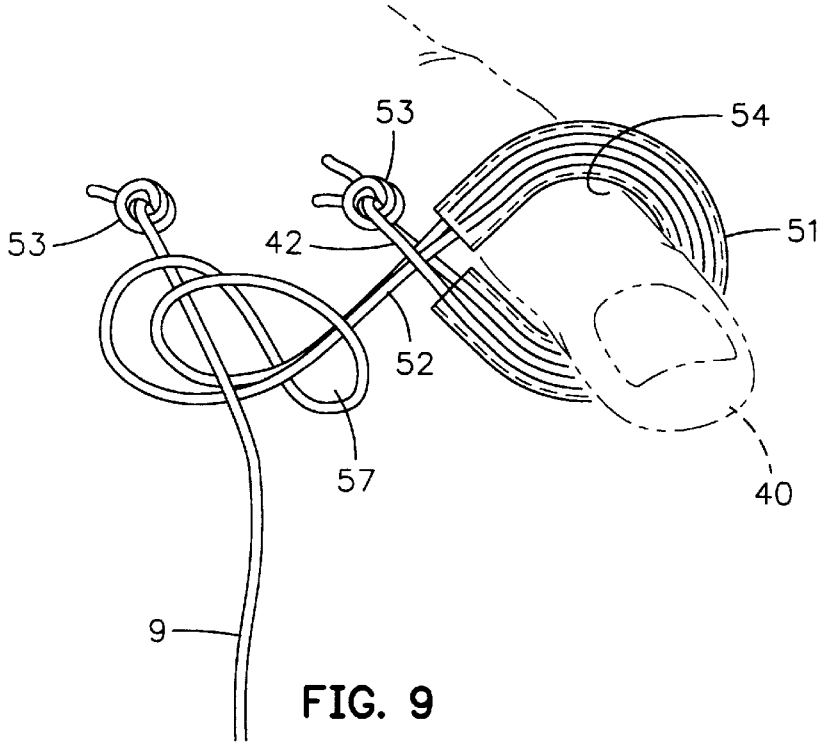
FIG. 9 is a perspective view of a yo-yo string engaged with a preferred embodiment of the string finger guard.

Yet another embodiment of the string finger guard is shown in FIG. 9. In this embodiment the leash 52 is somewhat longer than the sleeve 51. Preferably, the sleeve 51 is positioned near an end of the leash 52 and end 57 is threaded through the leash forming a running knot 42 and an opening 54 though which a player's finger 40 is inserted. End 57 is then coupled to, or wrapped around the string 9 and the sleeve 51 is threaded through the end 57 attaching the leash 52 to the string 9. The sleeve 51 keeps the leash from collapsing and allows the finger 40 to be easily inserted into the noose, or opening. Also, the soft sleeve cushions and protects the finger from excessive pinching. FIG. 10 shows a similar configuration as FIG. 9, however the leash 52 is comprised of a section of doubled-back string 9.

Once the string, or tether 9 is attached to the finger of a player, by conventional means, or by the above described string finger guard system, the player "throws" the yo-yo 6 causing the yo-yo to unwind along the string resulting in the yo-yo spinning, or rotating about axle 16. Referring to FIG. 2, the string is twisted about the bearing outer race and when the yo-yo is spinning the bearing outer race is stationary relative to the string. A yo-yo spinning at the end of a string is known as "sleeping."

String 9 represents a commonly available yo-yo string that is made of cotton but changes characteristics with age and use. New strings are "fat," but as the cotton wears the string thins out, and the string surface becomes smoother as it is wound and unwound from around the yo-yo 6. The varying string thickness and surface quality results in constantly changing "play" characteristics, which affects the tendency for the yo-yo to sleep. Prior art yo-yos would sleep too much, i.e., not return up the string into the hand of the player, as the string wore and became smoother, and "thinner." Referring to FIG. 4, yo-yo webs 11 are coupled to hubs 20 which are threadably engaged about axle 16. The web gap 35 can be adjusted by rotating, or twisting the webs relative to the axle and advancing the hubs on the axle threads. Increasing or decreasing the web gap affects the tendency for the yo-yo to sleep, as the web inner surface 12 can better engage the string 9. The yo-yo can now be quickly, and easily adjusted to optimize sleep characteristics as string 9 wears. As most tricks are performed while the yo-yo is sleeping, but not completed until the yo-yo returns to the hand of the player, the quick-adjustable sleep feature is an important aspect of the present invention.

Other embodiments

While I have illustrated and described my invention by means of specific embodiments, it is to be understood that numerous changes and modifications may be made therein without departing from the spirit and the scope of the invention as shown in the appended claims. An alternate embodiment of the invention may be constructed with straight webs, or integral rings and bands, or the bands, rings, and webs could have different radii and weights.

What is claimed is:

1. A yo-yo for use with a string, comprising:

an axle assembly;

a pair of dish shaped webs comprised of a low density material coupled to the axle assembly so that a gap is formed between the webs;

a hoop comprised of a high density material mounted about an outer perimeter of each web, a weight of each hoop is greater than a weight of each web, wherein each hoop comprises two parts with a first part coupled to said outer perimeter of the web and a second part coupled to a perimeter of the first part.

2. The apparatus according to claim 1, wherein a ratio between the weight of the hoop and the weight of the web is at least 1.75 to 1, respectively.

3. The apparatus of claim 1, wherein the axle assembly comprises a threaded shaft with a bearing mounted about the shaft, wherein the bearing has an inner and an outer race.

4. The apparatus of claim 3, wherein the axle assembly further comprises a plurality of washers for fixing the inner race relative to the axle assembly while allowing the outer race to rotate relative to the axle assembly.

5. The apparatus of claim 1, further including a hub coupled to each web for threadably engaging onto the axle assembly so that the gap between the two webs is variable.

6. The apparatus of claim 1, wherein each web is composed of a material selected from the group consisting of carbon-fiber, graphite, KEVLAR, SPECTRA, and fiberglass.

7. The apparatus of claim 1, wherein the two parts are composed of materials selected from the group consisting of copper, steel, brass, aluminum, titanium, rubber, and doped rubber.

8. The apparatus of claim 1, wherein the yo-yo weighs between 35 and 65 grams, and at least 50% of the weight is disposed about a perimeter of the two webs.

9. The apparatus of claim 1, and further comprising a leash and a substantially cylindrical sleeve for protectively covering said leash that connects the yo-yo to a finger of a player.

10. The apparatus of claim 9, wherein the leash is formed by a section of the string.

11. The apparatus of claim 9, wherein the leash is composed of a material selected from the group consisting of cotton, hemp, polyester, nylon, plastic, rubber, KEVLAR, and SPECTRA.

12. The apparatus of claim 1, wherein the axle assembly comprises a threaded shaft with a bearing mounted about the shaft, the bearing having an inner and outer race.

13. The apparatus of claim 12, further comprising a plurality of washers for fixing the inner race relative to the axle assembly while allowing the outer race to rotate relative to the axle assembly.

14. The apparatus of claim 1, wherein each web comprising a hub threadably engaging onto the axle assembly so that the spaced apart relationship between the two hubs is variable.

15. A yo-yo for use with a string, comprising:

two circular disks made of a first material, each disk having a center of rotation, and an outer perimeter;

an annular member of at least one other material mounted about the outer perimeter of each disk;

a threaded axle assembly positioned at the center of rotation of each disk;

a roller bearing sandwiched between a plurality of washers, all captured on the axle assembly by two rubber O-rings;

two threaded hubs, each coupled to the center of rotation of each disk, for threadably engaging the threaded axle and compressing the O-rings against the plurality of washers so that an inner race of the roller bearing is fixed relative to the axle, and an outer race of the roller bearing is free to rotate; and wherein the yo-yo weighs about 53 grams, with at least 50% of the weight of the yo-yo disposed about the perimeter of the two disks thereby maximizing the rotational inertia of the yo-yo.

16. The apparatus of claim 15, and further comprising a substantially cylindrical sleeve for protectively covering a leash that connects the yo-yo to a finger of a player.

17. The apparatus of claim 15, wherein a leash is formed by a section of a string.

18. The apparatus of claim 15, including a leash composed of a material selected from the group consisting of cotton, hemp, polyester, nylon, plastic, rubber, KEVLAR, and SPECTRA.

19. A yo-yo kit for use with a string, comprising in combination:

two circular disks made of a first material, each disk having a center of rotation, and an outer perimeter;

an annular member of at least one other material mounted about the outer perimeter of each disk;

a threaded axle assembly positioned at the center of rotation of each disk;

a roller bearing sandwiched between a plurality of washers, all captured on the axle assembly by two rubber O-rings;

two threaded hubs, each coupled to the center of rotation of each disk, for threadably engaging the threaded axle and compressing the O-rings against the plurality of washers so that an inner race of the roller bearing is fixed relative to the axle, and an outer race of the roller bearing is free to rotate, and wherein the yo-yo weighs about 53 grams, with at least 50% of the weight of the yo-yo disposed about the perimeter of the two disks thereby maximizing the rotational inertia of the yo-yo;

a flexible sleeve having a hollow center;

a flexible hitch slidably positioned in the hollow center; and the string coupled to the hitch whereby the flexible sleeve protects a finger of a player from the string.

20. The apparatus of claim 19, wherein the flexible hitch is formed by the string.

21. A yo-yo for use with a string, comprising:

an axle assembly;

a pair of dish shaped webs of a low density material selected from the group consisting of carbon-fiber, graphite, KEVLAR, SPECTRA, and fiberglass mounted on the axle assembly so that a gap is formed between the webs;

a hoop of a high density material mounted about an outer perimeter of each web, wherein each hoop has a weight greater than a weight of each web, wherein each hoop comprises two parts with a first part coupled to said outer perimeter of the web and a second part coupled to a periphery of the first part.

22. The apparatus of claim 21, wherein the two parts are composed of materials selected from the group consisting of copper, steel, brass, aluminum, titanium, rubber, and doped rubber.

23. The apparatus of claim 22, wherein the yo-yo weighs between 35 and 65 grams, and at least 50% of the weight is disposed about a perimeter of the two sections.

24. The apparatus of claim 23, and further comprising a leash and a substantially cylindrical sleeve for protectively covering said leash that connects the yo-yo to a finger of a player.

25. The apparatus of claim 24, wherein the leash is formed by a section of a string.

26. The apparatus of claim 24, wherein the leash is composed of a material selected from the group consisting of cotton, hemp, polyester, nylon, plastic, rubber, KEVLAR, and SPECTRA.

* * * * *